US009157302B2

(12) United States Patent
Scarsdale et al.

(10) Patent No.: US 9,157,302 B2
(45) Date of Patent: Oct. 13, 2015

(54) METHOD FOR PROVIDING ROTATIONAL POWER IN A SUBSEA ENVIRONMENT

(75) Inventors: Kevin T. Scarsdale, Pearland, TX (US); Chris McLeod, West Vancouver (CA)

(73) Assignee: Schlumberger Technology Corporation, Sugar Land, TX (US)

( * ) Notice: Subject to any disclaimer, the term of this patent is extended or adjusted under 35 U.S.C. 154(b) by 912 days.

(21) Appl. No.: 12/339,534

(22) Filed: Dec. 19, 2008

(65) Prior Publication Data

US 2010/0155076 A1 Jun. 24, 2010

(51) Int. Cl.

| | |
|---|---|
| ***E21B 43/01*** | (2006.01) |
| ***E21B 41/04*** | (2006.01) |
| ***F04B 17/00*** | (2006.01) |
| ***E21B 43/12*** | (2006.01) |

(52) U.S. Cl.
CPC ..... *E21B 43/128* (2013.01)

(58) Field of Classification Search
CPC .. E21B 43/128; E21B 43/122; E21B 47/0007
USPC ..... 166/66.4, 66.5, 68, 372, 105, 357, 335, 166/351, 369; 417/202, 201, 205, 199.1, 417/248, 244
See application file for complete search history.

(56) References Cited

U.S. PATENT DOCUMENTS

| | | | | |
|---|---|---|---|---|
| 4,558,744 | A * | 12/1985 | Gibb | 166/335 |
| 4,900,433 | A | 2/1990 | Dean | |
| 5,474,601 | A * | 12/1995 | Choi | 96/182 |
| 5,708,337 | A * | 1/1998 | Breit et al. | 318/400.09 |
| 6,036,749 | A | 3/2000 | Ribeiro | |
| 6,299,672 | B1 | 10/2001 | Rivas | |
| 6,388,353 | B1 * | 5/2002 | Liu et al. | 310/156.09 |
| 6,557,642 | B2 * | 5/2003 | Head | 166/381 |
| 6,688,392 | B2 | 2/2004 | Shaw | |
| 6,811,382 | B2 * | 11/2004 | Buchanan et al. | 417/244 |
| 2005/0016735 | A1 * | 1/2005 | Ireland et al. | 166/352 |
| 2005/0217857 | A1 | 10/2005 | Rodrigues | |
| 2006/0118310 | A1 | 6/2006 | Euphemio | |
| 2006/0162934 | A1 | 7/2006 | Shepler | |
| 2007/0235195 | A1 | 10/2007 | Lawson | |
| 2009/0223662 | A1 * | 9/2009 | Shaw et al. | 166/250.15 |
| 2009/0232664 | A1 * | 9/2009 | Qu et al. | 417/44.1 |
| 2010/0147527 | A1 * | 6/2010 | Paulo | 166/339 |

FOREIGN PATENT DOCUMENTS

| | | |
|---|---|---|
| GB | 2369862 | 6/2002 |
| GB | 2419924 | 5/2006 |
| WO | 2007021335 | 2/2007 |
| WO | 2007021337 | 2/2007 |
| WO | 2007021335 | 4/2007 |

* cited by examiner

*Primary Examiner* — James G Sayre
(74) *Attorney, Agent, or Firm* — Michael Stonebrook

(57) ABSTRACT

A technique facilitates the pumping of fluids in a subsea environment. A pumping system is formed by combining a submersible pump with a permanent magnet motor to power the submersible pump. The pumping system is positioned in cooperation with a subsea structure to improve the fluid flow and the functionality of the system in specific applications.

4 Claims, 3 Drawing Sheets

METHOD FOR PROVIDING ROTATIONAL POWER IN A SUBSEA ENVIRONMENT

BACKGROUND

In a variety of subsea applications, fluids are pumped from one location to another. The fluids are pumped with pumping systems that often use a three phase induction motor coupled to a pump to power the pump. However, three phase induction motors have characteristics that can be limiting in many types of subsea environments. For example, such motors tend to have substantial length and lower torque output, and those attributes can be limiting in specific types of subsea applications and when pumping specific fluids, such as sandy or viscous fluids, that require substantial torque. The conventional induction motors also can be sub optimal in applications which require high start-up torque.

SUMMARY

In general, the present application provides a system and methodology for providing a power source in a subsea environment. For example, the power source may be used for pumping fluids in a subsea environment. A pumping system is formed by combining a submersible pump with a permanent magnet motor to power the submersible pump. The pumping system is positioned in cooperation with a subsea structure to improve fluid flow and to enhance the functionality of the system in specific subsea applications.

BRIEF DESCRIPTION OF THE DRAWINGS

Certain embodiments will hereafter be described with reference to the accompanying drawings, wherein like reference numerals denote like elements, and.

DETAILED DESCRIPTION

In the following description, numerous details are set forth to provide an understanding of the present application. However, it will be understood by those of ordinary skill in the art that embodiments of the claims herein may be practiced without these details and that numerous variations or modifications from the described embodiments may be possible.

The present application generally relates to a technique for providing a power source in a subsea environment to, for example, pump fluids. The technique is amenable to applications subject to space constraints and/or high torque requirements. In general, a system and methodology is provided for utilizing synchronous permanent magnet motors in subsea environments to pump fluids, such as hydrocarbon based fluids. Use of the synchronous permanent magnet motor also enables more efficient operation of the overall pumping system due to the ability of the motor to operate more efficiently than conventional induction motors of the same motor area.

The permanent magnet motor also enables generation of greater horsepower for the same motor area, and thus a substantially shorter motor can be employed in space restricted applications without sacrificing horsepower. The higher torque of the synchronous permanent magnet motor pumping system, particularly during start-up, also enables operation with systems and in environments that would otherwise be problematic. For example, the technique enables operation in highly viscous and/or sandy fluids that require high torque during start-up and operation.

Figure 1:
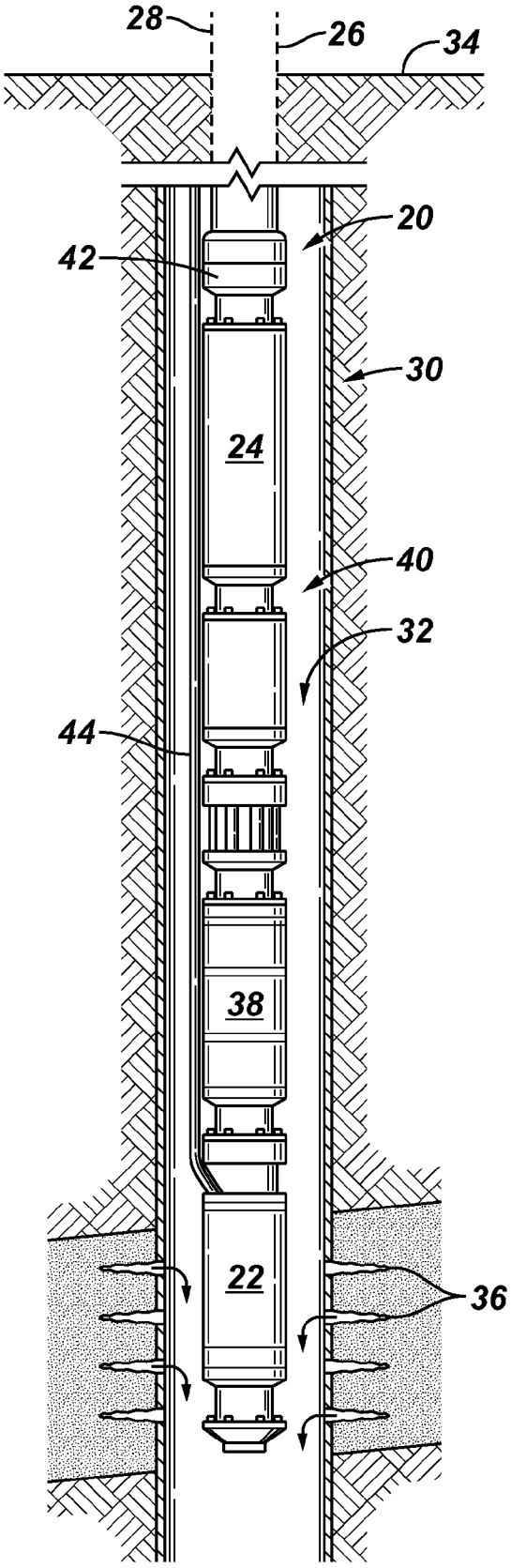
FIG. 1 is a front elevation view of a pumping system positioned in a subsea structure, according to an embodiment.

Referring generally to FIG. 1, an example of a pumping system 20 is illustrated according to one embodiment. In this embodiment, pumping system 20 comprises a synchronous permanent magnet motor 22 coupled to and driving a submersible pump 24. By way of example, the submersible pump 24 may comprise a centrifugal pump or other suitable pump that may be selected according to the specific application. The pumping system 20 is connected to a fluid flow system 26, such as a hydrocarbon fluid flow system, along which fluid is moved to/from the submersible pump 24. In FIG. 1, fluid flow system 26 comprises a tubing 28; however a variety of other fluid flow systems can be used in combination with pumping system 20. Furthermore, the pumping system 20 is used in cooperation with a subsea structure 30 that also may have a variety of forms depending on the specific pumping application. In FIG. 1, for example, the subsea structure 30 comprises a subsea well 32 with a wellbore extending downwardly from a seafloor 34. Hydrocarbon based fluids can enter subsea well 32 through a plurality of perforations 36.

Depending on the specific application of pumping system 20, the pumping system may comprise additional components. For example, pumping system 20 may comprise a motor protector 38 positioned between permanent magnet motor 22 and submersible pump 24 or at other suitable locations. Additionally, pumping system 20 may comprise an intake 40 through which fluid flows into submersible pump 24. A connector 42 can be designed to connect pumping system 20 into a variety of fluid flow systems 26. Furthermore, a power cable 44 may be used to deliver electrical power to the synchronous permanent magnet motor 22.

Figure 2:
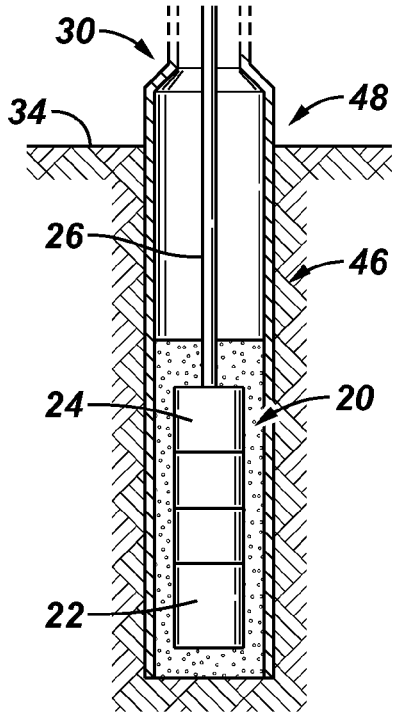
FIG. 2 is a schematic view illustrating the pumping system in a specific subsea application, according to an embodiment.
Figure 4:
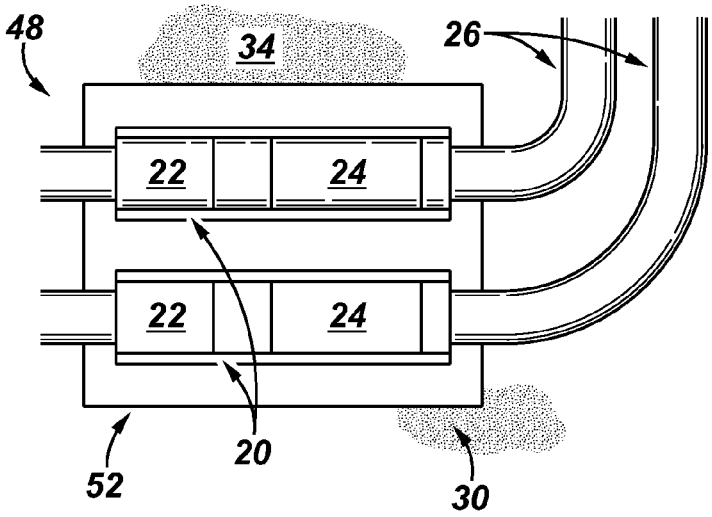
FIG. 4 is a schematic view illustrating the pumping system in another specific subsea application, according to an embodiment.

Referring generally to FIG. 2, another pumping application is illustrated. In this embodiment, pumping system 20 is employed in cooperation with the subsea structure 30 which is constructed as a vertical separation system. For example, the subsea structure 30 may comprise a vertical annular separation and pumping system 46 positioned at a subsea location 48. The pumping system 20 is positioned in the vertical annular separation and pumping system 46 to facilitate separation of fluids. The small size of permanent magnet motor 22, as well as its high torque capability, improves the functionality of the pumping system in this type of application.

Figure 3:
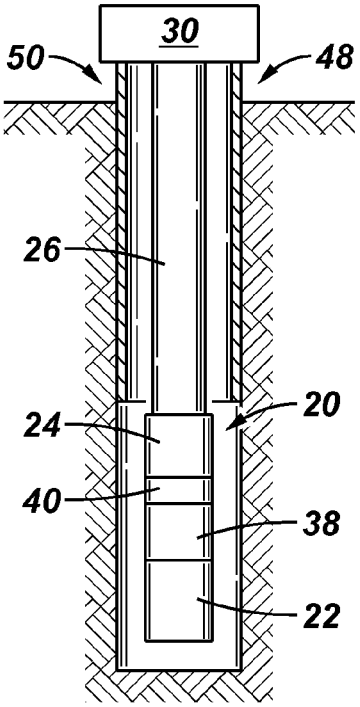
FIG. 3 is a schematic view illustrating the pumping system in another specific subsea application, according to an embodiment.

Referring generally to FIG. 3, another pumping application is illustrated in which pumping system 20 is employed in cooperation with another type of subsea structure 30. In this embodiment, the subsea structure 30 comprises a caisson 50 positioned at the subsea location 48. The pumping system 20 may be positioned within or otherwise positioned for cooperation with a variety of caissons 50 that are utilized in many types of subsea applications. Again, the small size of permanent magnet motor 22, as well as its high torque capability, expands the potential uses of the pumping system 20 within, or at least in cooperation with, caisson structures.

In another subsea application, one or more pumping systems 20 are deployed at subsea location 48 on, for example, seafloor 34 as part of a subsea booster system 52. In many applications, the subsea booster system 52 is used to move desired fluids, including viscous fluids, sandy fluids, and other fluids that require substantial torque applied to the pump. For example, hydrocarbon based fluids can be pumped through fluid flow system 26, via tubing 28, over substantial distances along the seafloor 34 and to a variety of surface collection locations. In this application, the small size of permanent magnet motor 22, as well as its high torque capability, is again able to improve the ability to move a greater variety of fluids, over greater distances, in many types of subsea environments.

Figure 5:
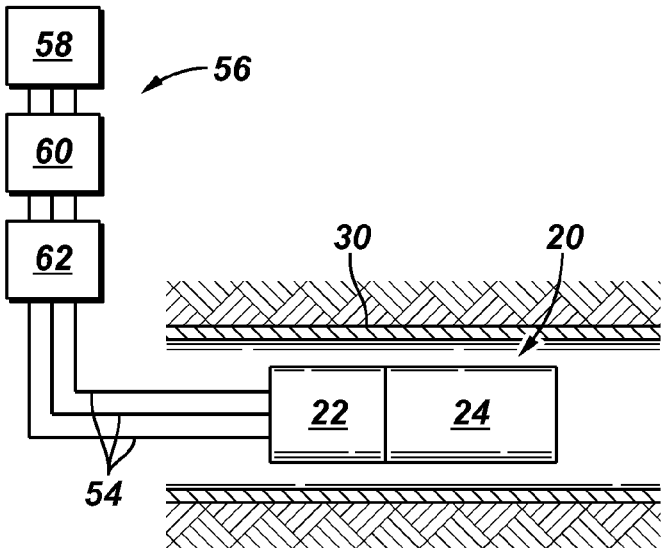
FIG. 5 is a schematic view illustrating one example of a pumping system control, according to an embodiment.

The one or more pumping systems 20 can be controlled via a variety of control systems. However, one example of a suitable control system is illustrated in FIG. 5. In this example, the synchronous permanent magnet motor 22 receives power via three conductors 54. The three conductors 54 may be used to carry three-phase power for powering the permanent magnet motor. The flow of power is controlled via a control system 56 which may be positioned at the surface or at a subsea location. According to one embodiment, control system 56 utilizes a variable speed drive 58 coupled to a transformer 60. Transformer 60 is used for voltage step-up and to eliminate magnetic saturation at low frequencies. The control system 56 also may comprise a junction box 62 designed to connect transformer 60 and conductors 54 which may be disposed within power cable 44. It should be noted that other types of suitable control systems 56 also can be used to enable control over pumping system 20.

Figure 6:
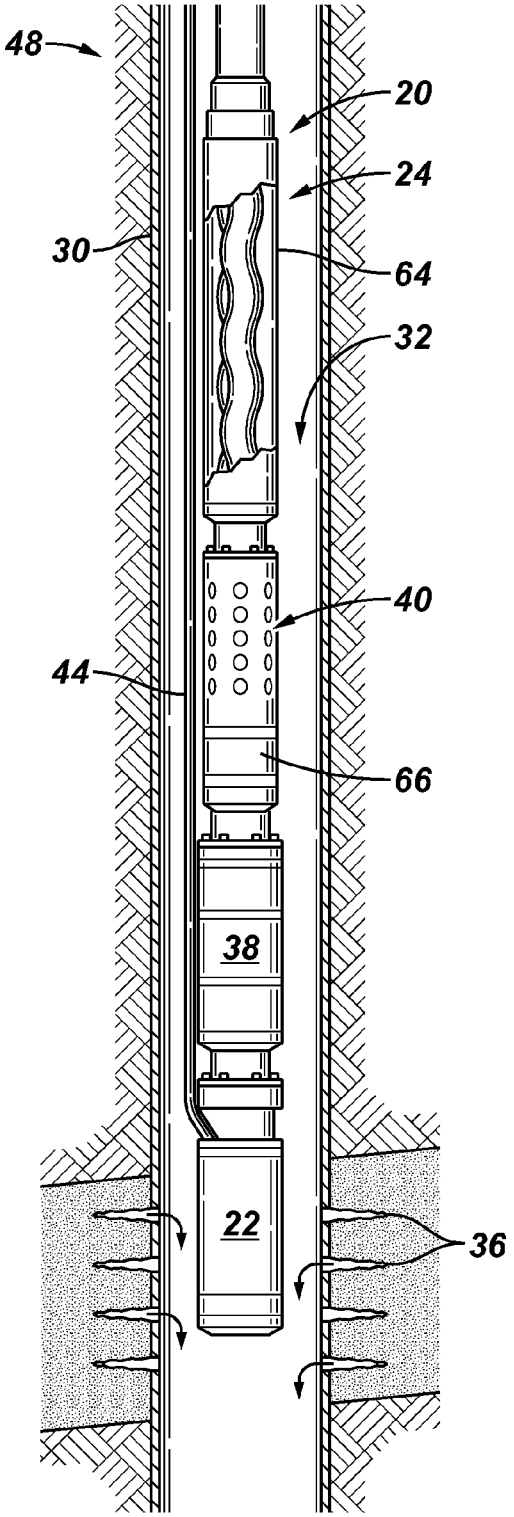
FIG. 6 is an illustration of a permanent magnet motor coupled to one example of a submersible pump, according to an embodiment.

Depending on the specific subsea pumping application, the synchronous permanent magnet motor 22 may be joined with one or more submersible pumps having a variety of configurations. As illustrated in the FIG. 6, for example, permanent magnet motor 22 is connected to a progressing cavity pump 64. Other components also can be incorporated into the overall pumping system 20 according to the needs of a specific application. For example, motor protector 38 can be positioned between permanent magnet motor 22 and progressing cavity pump 64 or at other suitable locations. Additionally, a gearbox 66 can be positioned between motor 22 and pump 64 to change the rotational speed. In many applications, for example, the rotational speed of the shaft of permanent magnet motor 22 can be reduced for operation of progressing cavity pump 64. Intake 40 also may be positioned to enable entry of a desired fluid, e.g. a hydrocarbon based fluid, into the system.

Figure 7:
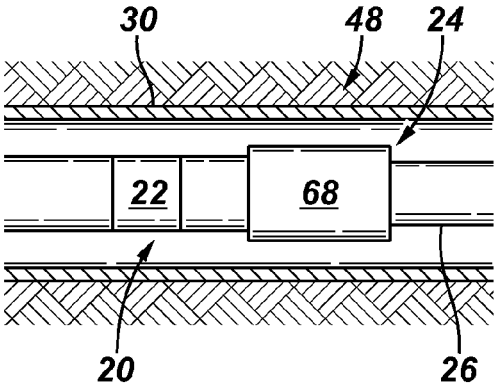
FIG. 7 is an illustration of a permanent magnet motor coupled to another example of a submersible pump, according to an embodiment.

In another example, the synchronous permanent magnet motor 22 is coupled with a positive displacement pump 68, as illustrated in FIG. 7. Again, other components may be joined into the overall pumping system 20 according to the needs of a specific application. For example, motor protector 38 can be positioned between permanent magnet motor 22 and positive displacement pump 68 or at other suitable locations. The positive displacement pump 68 may be used to move fluid along fluid flow system 26 in many types of subsea environments and applications.

Figure 8:
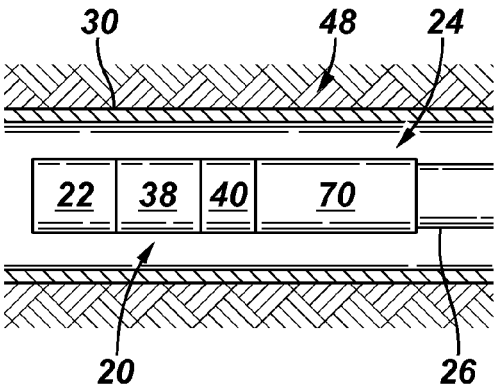
FIG. 8 is an illustration of a permanent magnet motor coupled to another example of a submersible pump, according to an embodiment.

The synchronous permanent magnet motor 22 also may be used to power an axial flow pump 70, as illustrated in FIG. 8. Depending on the specific subsea application, many additional components can be combined into the overall pumping system 20. For example, motor protector 38 can be positioned between permanent magnet motor 22 and axial flow pump 70 or at other suitable locations. Other components, such as intakes, gauges, sensors, separators, and other pumping system related components can be combined with the pump 24, e.g. axial flow pump 70, and permanent magnet motor 22.

The examples discussed above are just a few of the configurations and systems that can be used to pump fluids in subsea environments. The synchronous permanent magnet motor 22 enables and/or improves the functionality of the pumping system with a wider variety of fluids, systems and environments. The pumping system can be incorporated into specific subsea structures that benefit from the size and torque output of the permanent magnet motor and corresponding pumping system. Depending on the subsea application, additional components can be added to the pumping system to achieve a desired functionality. Furthermore, the type of pump driven by the synchronous permanent magnet motor may be selected according to the type of fluid being pumped and according to the specific pumping structure and fluid distribution system. For example, the type of pump may vary according to a viscosity or a sand content of a hydrocarbon fluid being produced. Additionally, the size and configuration of the permanent magnet motor may vary, and different types of control systems can be employed to control operation of the motor and overall pumping system.

Although only a few embodiments have been described in detail above, those of ordinary skill in the art will readily appreciate that many modifications are possible without materially departing from the teachings of this application. Accordingly, such modifications are intended to be included within the scope as defined in the claims.

What is claimed is:

1. A method, comprising:

determining an outside diameter and a length of a section of a tubing of a subsea hydrocarbon flow structure;

substituting a section of the tubing with an axial pumping system comprising a synchronous permanent magnet motor axially connected to a pump and having an outside diameter suitable for connecting inline with the tubing; and initiating operation of the synchronous permanent magnet motor for boosting a flow through the tubing.

2. The method as recited in claim 1, wherein the pump comprises one of a positive displacement pump, a centrifugal pump, a progressing cavity pump, and an axial flow pump, and the synchronous permanent magnet motor is immersed in a fluid flow through the tubing.

3. The method as recited in claim 1, wherein initiating operation comprises initiating operation in a viscous hydrocarbon fluid.

4. The method as recited in claim 1, wherein initiating operation comprises initiating operation in a sandy fluid.

* * * * *